US009617120B2

(12) United States Patent
Kere

(10) Patent No.: US 9,617,120 B2
(45) Date of Patent: Apr. 11, 2017

(54) ELEVATOR CAR AND AN ELEVATOR

(71) Applicant: KONE CORPORATION, Helsinki (FI)

(72) Inventor: Petri Kere, Helsinki (FI)

(73) Assignee: KONE CORPORATION, Helsinki (FI)

( * ) Notice: Subject to any disclaimer, the term of this patent is extended or adjusted under 35 U.S.C. 154(b) by 427 days.

(21) Appl. No.: 14/229,217

(22) Filed: Mar. 28, 2014

(65) Prior Publication Data

US 2014/0305748 A1 Oct. 16, 2014

(30) Foreign Application Priority Data

Apr. 16, 2013 (EP) ..... 13163844

(51) Int. Cl.
*B66B 11/02* (2006.01)

(52) U.S. Cl.
CPC ..... *B66B 11/0206* (2013.01); *B66B 11/0226* (2013.01)

(58) Field of Classification Search
CPC B66B 11/0226; B66B 11/024; B66B 11/0233
USPC ..... 29/896.6, 897.32, 897.35
See application file for complete search history.

(56) References Cited

U.S. PATENT DOCUMENTS 4,462,193 A * 7/1984 Ericson ..... B66B 11/0253 24/306
4,594,281 A * 6/1986 Haraga ..... B32B 3/28 428/172
4,635,756 A 1/1987 Sherwood et al.
5,374,466 A 12/1994 Bleasdale
5,454,449 A * 10/1995 Makimattila ..... B66B 11/0253 187/401
6,209,686 B1 * 4/2001 Tomasetti ..... B66B 11/0206 187/401
6,770,349 B2 * 8/2004 Itoh ..... B29C 73/04 29/402.01

(Continued)

FOREIGN PATENT DOCUMENTS

CH FR 2464214 A1 * 3/1981 ..... B66B 11/0226
CH EP 0972738 A1 * 1/2000 ..... B66B 11/0206

(Continued)

*Primary Examiner* — William A Rivera
*Assistant Examiner* — Stefan Kruer
(74) *Attorney, Agent, or Firm* — Birch, Stewart, Kolasch & Birch, LLP

(57) ABSTRACT

An elevator car includes a suspension device for supporting the elevator car in the elevator hoistway and a car box. A floor, vertical beam, and roof beam elements form a load-bearing frame structure of the car box. A plurality of planar elements of rectangular shape are fixed side-by-side to the frame structure and extend essentially from one edge side of the car box to another. The frame structure and/or said planar elements of said car box comprises one or more sandwich type beam and/or plate elements comprising a first skin and a second skin and one or more core elements. The core elements are formed from the first skin by cutting and bending or by punching through one or more core members from the cutting edge of the first skin towards the second skin and by joining the core members to the second skin of the beam and/or plate element.

20 Claims, 3 Drawing Sheets

(56) References Cited

U.S. PATENT DOCUMENTS

| | | | | |
|---|---|---|---|---|
| 7,820,302 | B2 * | 10/2010 | Krettenauer | E04C 2/08 29/896.6 |
| 2005/0145443 | A1 * | 7/2005 | Friedman | B66B 11/0226 187/401 |
| 2008/0296100 | A1 * | 12/2008 | Lee | B66B 11/0226 187/401 |
| 2010/0015420 | A1 * | 1/2010 | Riebel | B32B 27/06 428/203 |

FOREIGN PATENT DOCUMENTS

| | | | | | |
|---|---|---|---|---|---|
| DE | 9405750 | U1 * | 6/1994 | ..... | B66B 11/0226 |
| DE | 102009036329 | A1 * | 2/2011 | ..... | B66B 11/0226 |
| EP | 0566424 | A1 * | 10/1993 | ..... | B66B 11/0226 |
| EP | 1 970 341 | A1 | 9/2008 | | |
| FI | WO 03045829 | A1 * | 6/2003 | ..... | B66B 11/0253 |
| FI | EP 2816000 | A1 * | 12/2014 | ..... | B66B 11/0226 |
| FR | 1149995 | A * | 1/1958 | ..... | B66B 11/0226 |
| JP | WO 2009050807 | A1 * | 4/2009 | ..... | B66B 11/0206 |
| WO | WO 99/33743 | A1 | 7/1999 | | |

* cited by examiner

Fig. 4a
Fig. 4b
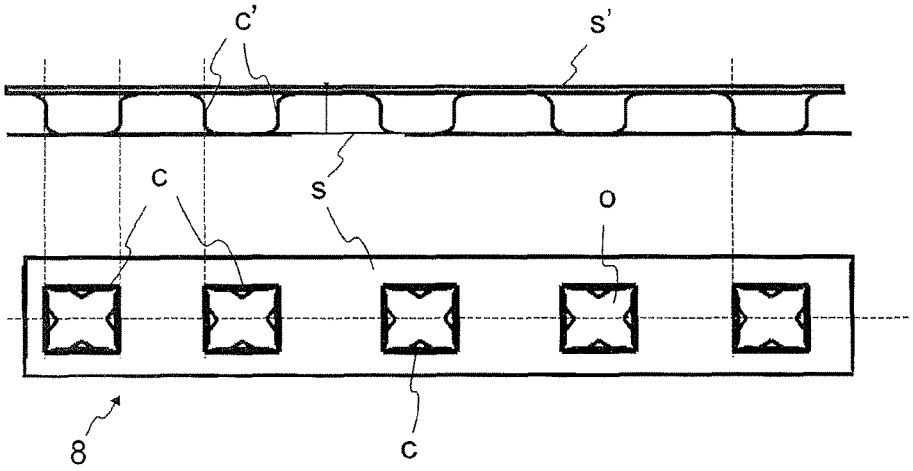
Fig. 5
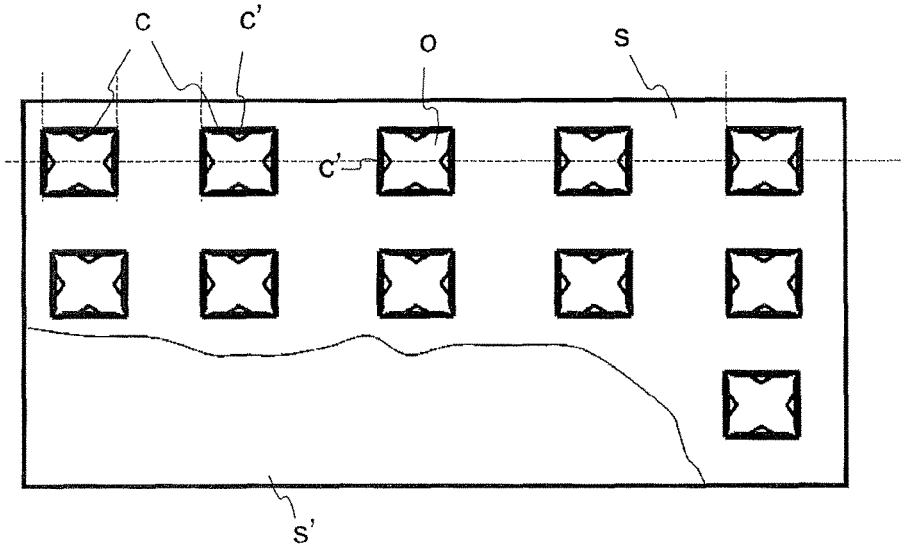

ELEVATOR CAR AND AN ELEVATOR

FIELD OF THE INVENTION

The object of the invention is an elevator car and an elevator, more particularly an elevator car and an elevator applicable to the transporting of people and/or of freight.

BACKGROUND OF THE INVENTION

Elevator cars are conventionally formed to comprise a car box and suspension means, which suspension means comprise hoisting roping and a load-bearing frame, which comprises a lower horizontal beam system, an upper horizontal beam system, and also a vertical beam system of a first side and a vertical beam system of a second side, which beam systems are connected to each other so that they form a closed sling, inside which is an interior comprised in a car box fixed to the beam systems, which interior can receive freight and/or passengers for conveying them in the interior of the elevator car.

Conventionally the car box of an elevator has been essentially fully inside the aforementioned sling. Also known in the art are elevator cars, in which the beams participating in forming the sling structure of the aforementioned load-bearing frame are integrated as a part of the wall structures, roof structures or floor structures bounding the interior of the car box. This type of solution is presented in, among others, publications EP1970341 and WO9933743. The vertical space usage is very efficient, but nevertheless some free space remains unutilized and modification of the elevator car according to site regulations and customer needs is not possible.

The outer surface of the roof of an elevator car is generally formed from plates that are firmly and rigidly supported on the upper horizontal beam system. According to prior art, there is a separate ceiling panel in the elevator cars, below the upper horizontal beam system and the aforementioned plates forming the outer surface. The roof panel can be a single-piece or multi-piece roof panel, and the bottom surface of it forms a planar surface bounding the interior of the car. The roof panel is generally a plate-type structure that is quite thin in terms of its thickness, into which luminaires are sunk. The ceiling panel structure has increased the total thickness of the roof structure by the amount of its own thickness plus possible fastening clearances. Using this type of conventional method in connection with solutions according to prior art produces an unnecessarily thick, heavyweight and technically complex roof entity that is expensive in terms of its manufacturing costs.

BRIEF DESCRIPTION OF THE INVENTION

The object of the invention is, inter alia, to solve one or more of the previously described drawbacks of known solutions and problems discussed later in the description of the invention. An object of the invention is, in particular, to provide an elevator and an elevator car thereof, which is the structure of the elevator car of which is lightweight and easily adaptable according to the needs of the operating site.

It is brought forward a new elevator car for an elevator, comprising suspension means for supporting the elevator car in the elevator hoistway and a car box, which car box comprises

- a free interior for receiving and transporting freight and/or passengers in the interior of the car box of the elevator, which interior is bounded by at least the floor, walls, roof, and preferably also a door arrangement comprised in the car box,
- a floor element, vertical beam elements, and roof beam elements, which said floor, vertical beam, and roof beam elements are connected to each other such that they form a load-bearing frame structure of rectangular prism shape of the car box of the elevator,
- on the inside of which frame structure is a plurality of planar elements of rectangular shape fixed side-by-side to said frame structure and extending essentially from one edge side of the car box to another, from which plurality a uniform wall surface and/or roof surface of the car box is formed.

Said frame structure comprises one ore more sandwich type beam and/or plate elements comprising a first skin and a second skin and one or more core elements, which said core element is formed from said first skin by cutting and bending or by punching through one or more core members from the cutting edge of said first skin towards said second skin and by joining said core members to said second skin of said beam and/or plate element. Furthermore, said planar elements of rectangular shape on the wall surface and/or on the roof surface comprise sandwich type plate elements comprising a first skin and a second skin and one or more core elements, which said core element is formed from said first skin by cutting and bending or by punching through one or more core members from the cutting edge of said first skin towards said second skin and by joining said core members to said second skin of said plate element. Thus an elevator is achieved wherein the structure of the elevator car is lightweight still offering stiffness of the load-bearing frame structure and wall and/or roof plate elements enabling parametric design of the elevator car for elevators of different sizes.

In a preferred embodiment, the core elements are formed by cutting and bending or by punching through one or more, preferably two, most preferably four core members symmetrically or asymmetrically with respect to the opening of said skin core elements. Thus an elevator car is achieved wherein the sandwich structure of the beam or plate element is optimized for the operating site.

In a preferred embodiment, at least one edge of said core member is straight. In a preferred embodiment, at least one edge of said opening is straight. Thus an elevator car is achieved wherein manufacturing the sandwich structure of the beam or plate element is cost effective.

The core elements are formed by cutting and bending or by punching through one or more core members of said first skin towards said second skin or of said second skin towards said first skin, or of both said first and second skins towards the opposite side skin.

Thus an elevator is achieved wherein the structure of the beam or plate element of the elevator car is cheaper than before to manufacture and optimized for the operating site.

In a preferred embodiment, the first skin and the second skin are of metallic material, preferably stainless steel or aluminum. Thus an elevator is achieved wherein the joint surfaces of wall elements, roof elements and floor elements of the car box of the elevator car and the fixing of the car box to the frame structure is harmonized for connecting elements of different types and manufactured from different materials to the car box.

In a preferred embodiment, the aforementioned first skin is of metallic material, preferably stainless steel or aluminum, and the aforementioned second skin is of non-metallic material, preferably plywood, plastic or glass-, aramid- or carbon fiber reinforced laminated polymer composite material. Plastic and polymer matrix material can be thermoplastic or thermoset depending on the needs of the installation site. Thus an elevator is achieved, the materials of the wall elements of the car box of the elevator car of which can be selected according to the regulations and needs of the installation site.

In a preferred embodiment, the aforementioned first skin is of fire retardant plywood and is coated with a material layer comprising a fire retardant laminate or is of metallic material, preferably stainless steel or aluminum. The aforementioned second skin is of fire retardant material layer comprising a laminate at the front surface of the plywood and the second material layer at the back surface of the plywood stiffening the plywood and eliminating curving of the plywood. The laminate at the front surface also gives an appealing appearance to the board. The laminate should be as thin as possible in order to increase the thickness and the weight of the board as little as possible. The thickness of the fire retardant laminate is in one embodiment in the range of 0.4 to 1 mm. Laminate sheets having a standard width of 1300 or 1500 mm can e.g. be used to cover the plywood. The fire retardant laminate may be formed of melamine impregnated decorative paper combined with fire retardant phenolic treated kraft paper. The fire retardant laminate can be rated at least in the fire class B-s2,d1 according to the European fire classification standard EN 13501-1.

In a preferred embodiment, the aforementioned core members formed from said first skin and/or said second skin are joined to said second skin and/or to said first skin by welding, spot welding, adhesive bonding, riveting or by press-formed joints.

In a preferred embodiment, the sandwich type plate element with said first skin and said second skin comprises one or more beam elements forming at least part of said first skin and comprising one or more core elements which said core elements are formed from said first skin by cutting and/or punching through and forming said core members from the cutting edges towards said second skin and by joining said core member to the second skin of said plate element. Thus an elevator is achieved wherein the distribution direction of the wall elements of the car box of the elevator car can easily be changed from vertical to horizontal without significant changes to the frame structure of the car box.

In a preferred embodiment, the car box comprises a beam or a plate element, which comprises ventilation ducts and/or ventilation openings and/or communications cables and/or electricity cables, between a device of the elevator car and a control unit of the elevator car and/or an electricity source.

In a preferred embodiment, the floor element is a planar sandwich structure of rectangular shape, which comprises a sandwich type plate element comprising a first skin and a second skin and one or more core elements, which said core elements are formed from said first skin by cutting and bending or by punching through one or more core members from the cutting edge of said first skin towards said second skin and by joining said core members to said second skin of said plate element.

In one other embodiment, the floor element is a planar sandwich structure of rectangular shape, which comprises at least one skin plate and a core, which core is a flute or waved profile bent from metal or a honeycomb fabricated from thermoplastic, e.g. a polypropylene honeycomb, and said skin plates are of a metallic material and fixed to the core material by welding, spot welding, adhesive bonding, riveting or by press-formed joints.

In a preferred embodiment, the skin of said beam and/or plate elements are of a thickness of preferably 0.5-5 mm, more preferably 0.7-3 mm, most preferably 1-2 mm, and the thickness of the core of the sandwich is preferably 3-20 mm, more preferably 4-15 mm, most preferably 5-10 mm.

In a preferred embodiment, the outer surface of said beam and/or plate elements forms a part of the visible outer surface of the car box of the elevator and/or the inner surface of said beam and/or plate elements forms a part of the visible inner surface of the roof/wall bounding the free interior of the car box of the elevator. Thus an elevator is achieved, the space usage of the roof structure of the elevator car of which is more efficient than before.

In a preferred embodiment, the elevator car comprises suspension means of the elevator car that are separate from the roof of the car box. Thus an elevator is achieved, the wall structure and/or roof structure of the car box of the elevator car of which is composed of elements having different functionalities and is adaptable according to the regulations of the operating site by modifying the elements and the sequence of them with respect to each other.

It is also brought forward a new elevator comprising an elevator car and a counterweight arrangement, and a roping suspending the counterweight and the elevator car, and passing around the diverting pulley. The elevator car is as defined in any one of the preceding claims.

In a preferred embodiment, the elevator car is suspended with a hoisting roping passing below the car box of the elevator car.

In a preferred embodiment, the aforementioned beam elements have essentially the same continuous structure in the longitudinal direction of the beam, the width/height ratio of which cross-section is preferably at least 0.5, preferably 0.5-1, more preferably 0.7-0.9. One advantage is a rigid structure, and enables the fixing of the roof beams and other necessary structural elements, such as horizontal support elements for the wall elements, to the vertical beams.

In a preferred embodiment, the aforementioned roof beam elements are in their length such that they cover preferably at least most of the length and width of the car box of the elevator car in the plane direction.

In a preferred embodiment, the horizontal distance between the aforementioned horizontal parallel roof beam elements is at most 2000 mm, preferably at most 1500 mm, most preferably at most 1000 mm. In this way the roof beam structure is sufficiently rigid to function as a part of the load-bearing frame structure of the car box.

In a preferred embodiment, the aforementioned vertical beam elements are in their length such that they cover preferably at least most of the vertical height of the elevator car.

In a preferred embodiment, the aforementioned vertical beam elements are rigidly fixed to the aforementioned floor element. In this way the floor element is firmly positioned and withstands standing and at the same time stiffens the load-bearing frame structure of the car box.

In a preferred embodiment, the frame structure of the car box comprises one or more vertical stiffeners, which are fixed to the aforementioned roof beam element and to the aforementioned floor element for joining them rigidly together, and that the aforementioned vertical stiffener extends vertically from the roof beam right to the floor element for the distance of at least most of the length of the vertical beams. In this way the frame structure of the car box is durable and the stiffening effect of the frame structure is considerable.

In a preferred embodiment, the roof structure of the car box of the elevator car comprises one or more said sandwich type plate elements comprising said first skin and said second skin and said first skin comprising one or more core elements which said core elements are formed from said first skin by cutting and/or punching through and forming said core members from the cutting edges towards said second skin and by joining said core member to the second skin of said plate element. The bottom surface of roof element is placed against the top surfaces of the profile of the roof beam elements. Thus the aforementioned roof element is in the vertical direction simply supported in its position and withstands well the vertical loading exerted from outside on the surface of the roof element.

In a preferred embodiment, the roof structure of the car box of the elevator car comprises different functional roof elements. Thus the roof structure of the elevator car can be assembled according to varying structural and visual needs. Thus it is advantageous to assemble the roof structure according to the operating site to include the necessary functional elements and/or communication cabling and/or electrical wiring. Thus also the material and location of the functional roof elements in the roof structure of the car box of the elevator car can be varied preferably according to the regulations and needs of the operating site.

In a preferred embodiment, the roof structure of the car box of the elevator car comprises one or more roof plate elements of rectangular shape, the long side of which roof element is essentially the width of the elevator car in length and the short side can be selected from between preferably 200-1000 mm, even more preferably from between 300-800 mm, even more preferably from between 350-500 mm.

In a preferred embodiment, the roof structure of the car box of the elevator car comprises one or more roof plate elements, which comprises a bottom surface, which forms a surface bounding the interior, and that the bottom surface and top surface of the aforementioned roof element are at a vertical distance from each other such that a space is formed between them, in which space air is preferably conducted to travel between the interior and the elevator hoistway and/or electricity cables and/or communications cables. In this way the space of the roof of the elevator car can be efficiently utilized.

In a preferred embodiment, a roof plate element of the car box of the elevator car is supported against the aforementioned roof beam elements from below, which functional roof element comprises a bottom surface, which forms a surface bounding the interior. Thus the structure is very compact.

In a preferred embodiment, the structure of at least one luminaire integrated into the aforementioned roof plate element, preferably at least the light source and/or the reflective surface of the luminaire, is at least partly, preferably fully, beside the roof beam i.e. in the vertical direction at the point of the roof beam. Thus the structure is very compact.

In a preferred embodiment, the cross-sectional profile of each vertical beam element of the aforementioned car box comprises a vertical side surface, the width of which is preferably at least 10 mm, even more preferably at least 20 mm, most preferably at least 30 mm. Thus good rigidity and a compact structure are obtained for the vertical beams.

In a preferred embodiment, the cross-sectional profile of each roof beam element of the aforementioned car box comprises a horizontal top surface, the width of which is preferably at least 10 mm, even more preferably at least 20 mm, most preferably at least 30 mm. Thus good rigidity and a shallow structure are obtained for the roof beam.

In a preferred embodiment, the elevator car is suspended with hoisting roping, which is connected to the elevator car with means, such as via a diverting pulley system or equipment for fixing the ropes, which means are on the side of or below the elevator car.

In a preferred embodiment, the elevator car is suspended with hoisting roping, which is connected to the elevator car such that it supports the elevator car via a diverting pulley system supported on the elevator car.

In a preferred embodiment, the elevator car is suspended with hoisting roping passing around and below the elevator car.

The elevator as described anywhere above is preferably, but not necessarily, installed inside a building. The elevator is preferably of the type where the car is arranged to serve two or more landings. Then, the car preferably responds to calls from landing and/or destination commands from inside the car so as to serve persons on the landing(s) and/or inside the elevator car. Preferably, the car has an interior space suitable for receiving a passenger or passengers. The car may be provided with a floor, a ceiling, walls and at least one door these all forming together a closable and openable interior space. In this way, it is particularly well suitable for serving passengers.

Some inventive embodiments are also presented in the descriptive section and in the drawings of the present application. The inventive content of the application can also be defined differently than in the claims presented below.

The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. The features of the various embodiments of the invention can be applied within the framework of the basic inventive concept in conjunction with other embodiments. The additional features mentioned by each preceding embodiment can also singly and separately from the other embodiments form a separate invention.

BRIEF DESCRIPTION OF THE FIGURES

The invention will now be described mainly in connection with its preferred embodiments, with reference to the attached drawings, wherein:

FIG. 4*a* illustrates a cross-sectional view of a beam element according to a preferred embodiment of the invention.

FIG. 4*b* illustrates a top view of the beam element of FIG. 4*a*.

FIG. 5 illustrates a plate element according to one embodiment of the invention.

DETAILED DESCRIPTION OF THE INVENTION

Figure 1:
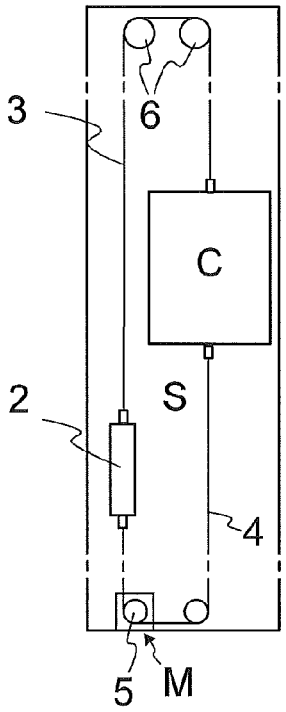
FIG. 1 illustrates an elevator according to a preferred embodiment.

FIG. 1 presents an elevator according to the invention, which comprises an elevator car 1, a counterweight 2, and suspension means comprising roping 3, the ropes of which connect the aforementioned elevator car 1 and aforementioned counterweight 2 to each other. The elevator car 1 and the counterweight 2 are arranged to be moved by exerting a vertical force on at least the elevator car 1 or on the counterweight 2. For this purpose the elevator comprises means M, 4, 5 for exerting the aforementioned force on at least the elevator car 1 or on the counterweight 2. The suspension roping 3 comprises one or more ropes. As presented the elevator comprises rope pulleys 6 in the proximity of the top end of the path of movement of the elevator car 1, while supported on which rope pulley 6 the ropes of the suspension roping 3 supports the elevator car 1 and the counterweight 2. In the embodiment presented this is implemented with a 1:1 suspension, in which case the aforementioned ropes of the suspension roping 3 are fixed at their first end to the elevator car 1 and at their second end to the counterweight 2. The suspension ratio could, however, be another, e.g. 2:1, but a 1:1 suspension ratio is advantageous because making a large number of bendings is not advantageous owing to the space taken by the bendings. Preferably the rope pulleys 6 are non-driven rope pulleys, namely in this way forces in the longitudinal direction of the rope are not exerted via the outer surface on the ropes of the roping. In this way also the top parts of the elevator can be formed to be spacious. It is advantageous that the rope pulleys 6 are in the elevator hoistway S, in which case a separate machine room is not needed.

In the solutions of FIG. 1, the traction roping 4 is connected to the elevator car and to the counterweight, more particularly suspended to hang from the elevator car 1 and from the counterweight 2, in which case the hoisting machine M can, via a traction sheave 5 and hoisting roping 4, exert either a downward pulling force on either of them whatsoever, depending on the desired direction of movement. It is not necessarily needed to connect the traction roping both to the elevator car 1 and to the counterweight 2.

The elevator hoisting roping 3 can also be guided to pass over a driven rope pulley, i.e., the traction sheave, the traction sheave being rotated by the hoisting machine M located in this case in the proximity of the top end of the path of movement of the elevator car 1. As the hoisting machine rotates, the traction sheave at the same time moves the elevator car 1 and the counterweight 2 in the up direction and down direction, respectively, due to friction.

Figure 2:
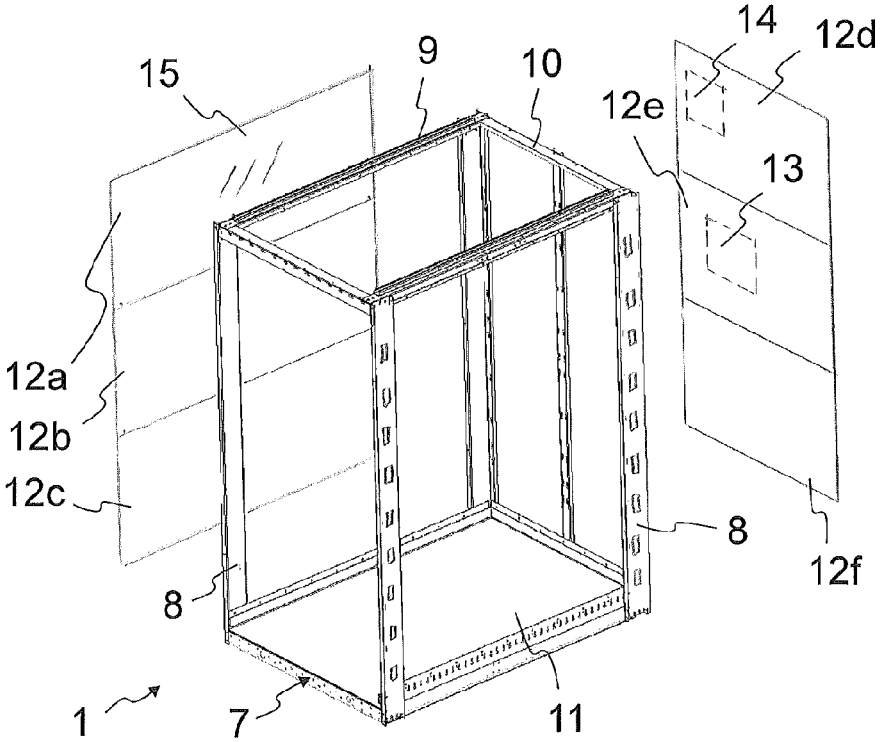
FIG. 2 illustrates structure of the car box of an elevator according to a preferred embodiment.

FIG. 2 presents the frame structure 7 of the car box of an elevator car 1 according to one embodiment of the invention, which frame structure 7 comprises four elongated vertical beam elements 8 and two horizontal, parallel, first elongated roof beams 9 in connection with the roof and fixed to the vertical beam elements 8 and two horizontal, parallel, second elongated roof beams 10 at a distance from each other and essentially orthogonal to the roof beams 9, which adjacent roof beams 9 and 10 are fixed to each other, and an interior, which is bounded by a space bordered by at least a planar floor element 11 of rectangular shape and the vertical beam elements 8 and the roof beams 9 and 10.

Figure 3:
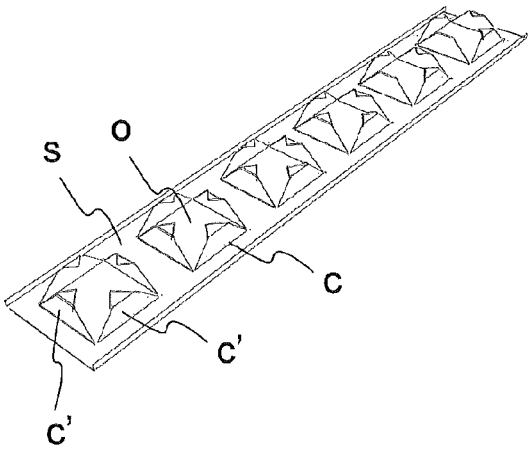
FIG. 3 illustrates a beam element according to one embodiment of the invention.

FIG. 3 presents one embodiment of a first skin s of a sandwich type beam element comprising several core elements c, which said core elements c are formed from said first skin s by cutting and bending or by punching through four core members c' from the cutting edge of said first skin s towards said second skin s'. The core elements c are formed by cutting and bending or by punching through four core members c' symmetrically with respect to the opening o of said skin s. The edges of said core member c' are straight and the edges of said openings o are straight.

The vertical beam elements 8 of the frame structure 7 of the car box are sandwich type beam elements 8 of FIGS. 4*a* and 4*b* comprising a first skin s and a second skin s' and several core elements c, which said core elements c are formed from said first skin s by cutting and bending or by punching through one or more core members c' from the cutting edge of said first skin s towards said second skin s' and by joining said core members c' to said second skin s' of said beam element 8. The second skin s' preferably is a decorative surface integrated into the element. The first skin s of said beam elements 8 can also be as shown in FIG. 3. The vertical profile beam elements 8 have essentially the same continuous cross-sectional profile in the longitudinal direction of the beam. Cuttings and apertures are arranged in the vertical beam elements 8 for fixing means for fixing the wall elements 12*a*-12*f* to the vertical beam elements 8. The vertical beam elements 8 of the frame structure 7 of the car box are rigidly fixed with fixing means to the vertical side edges of a planar floor element 11 of rectangular shape at the bottom edge of a vertical beam elements 8 and to the horizontal first roof beams 9 at the top edge of a vertical beam elements 8.

The rectangular, planar, wall elements 12*a*-12*f* presented in FIG. 1 comprise sandwich type plate elements comprising a first skin s and a second skin s' and one or more core elements c, which said core elements c are formed from said first skin s by cutting and bending or by punching through one or more core members c' from the cutting edge of said first skin s towards said second skin s' and by joining said core members c' to said second skin s' of said plate element. The wall elements 12*a*-12*f* also comprise one or more of the following functional features:

- sound-damping cladding integrated into the element,
- a passenger user interface 13 integrated into the element,
- an elevator control unit 14 integrated into the element,
- one or more ventilation openings integrated into the element,
- communications cables and/or electricity cables, between a device of the elevator car and a control unit of the elevator car and/or an electricity source, integrated into the element,
- a mirror 15 integrated into the element, and/or
- a decorative surface integrated into the element for covering an open point on the wall surface.

FIG. 1 presents the aforementioned wall elements 12*a*-12*f* shown in FIG. 5, which extend essentially from one side of the elevator car to the other and which are fixed with fixing means at least to the vertical beams 8. In the figure the wall elements 12*a*-12*f* are presented as distributed horizontally, i.e. the aforementioned wall elements are fixed to the frame structure 7 of the elevator car one on top of another in the vertical direction. The bottommost wall element is supported in a support element and the topmost wall element is additionally fixed with fixing means to a roof beam 9 and/or 10 of the frame of the elevator car. The wall elements can also be distributed vertically, in which case the aforementioned wall elements would extend essentially from a support element up to a roof beam 9 or 10 and the aforementioned wall elements could be fixed to the frame structure 7 of the elevator car one beside another in the horizontal direction, e.g. by fixing the wall elements with fixing means to the roof beams 9 or 10, to the vertical beams 8 and/or to a vertical stiffener.

FIG. 5 presents a planar sandwich type plate element comprising a first skin s and a second skin s' and several core elements c, which said core elements c are formed from said first skin s by cutting and bending or by punching through one or more core members c' from the cutting edge of said first skin s towards said second skin s' and by joining said core members c' to said second skin s' of said plate element. The bendings of said core elements c are round.

Figure 6:
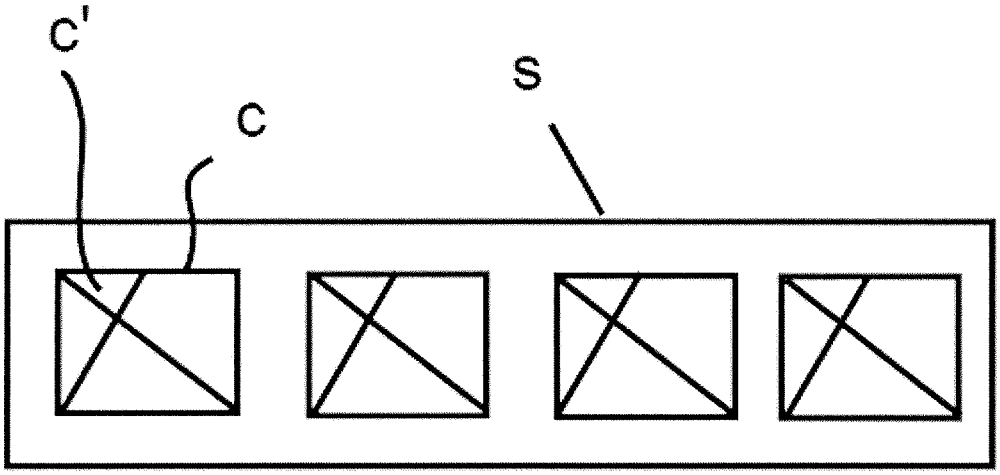
FIG. 6 illustrates a plate element where the core member are formed asymmetrically with respect to an opening of the skin of core elements.

FIG. 6 illustrates core elements c formed by cutting and bending or by punching through one or more, most preferably four core members c' asymmetrically with respect to the opening o of first skin s.

The floor element 11 in FIG. 1 is a planar sandwich structure of rectangular shape, which comprises sandwich type plate element comprising a first skin s and a second skin s' and several core elements c, which said core elements c are formed from said first skin s by cutting and bending or by punching through one or more core members c' from the cutting edge of said first skin s towards said second skin s' and by joining said core members c' to said second skin s' of said plate element by welding, spot welding, adhesive bonding, riveting or by press-formed joints.

The invention is based on the concept that the elevator car comprises suspension means for supporting the elevator car in the elevator hoistway and a car box to be assembled according to site regulations and customer needs, which car box comprises a free interior for receiving and transporting freight and/or passengers in the interior of the car box of the elevator, which interior is bounded by at least the floor, walls, roof, and preferably also door arrangement comprised in the car box, a floor element, vertical beams and roof beams, which floor element and vertical beams and roof beams are connected to each other such that they form a load-bearing frame structure, of rectangular prism shape, of the car box of the elevator, on the inside of which frame structure is a plurality of planar elements of rectangular shape fixed side-by-side to the frame structure and extending essentially from one edge side of the car box to another, from which plurality a uniform wall surface and/or roof surface of the car box is formed, and the plurality of which elements comprises elements differing to each other in respect of the functionalities integrated into the elements.

In a more refined embodiment of the concept according to the invention the aforementioned load-bearing frame and the car box are separate from each other and the load-bearing frame is fixed to the car box essentially via the floor element.

In a more refined embodiment of the concept according to the invention the aforementioned load-bearing frame is integrated into the car box, in which case at least the floor element forms a part of the load-bearing frame.

In a more refined embodiment of the concept according to the invention the frame structure of the car box of the elevator car comprises a floor element, above which is the aforementioned interior and which floor element rigidly connects the aforementioned vertical beams and on which floor element means, such as diverting pulleys or rope clamps, for connecting the hoisting ropes to the elevator car are supported.

In a more refined embodiment of the concept according to the invention the aforementioned frame structure of the car box of the elevator car comprises the vertical beam(s) of a first side and the vertical beam(s) of a second side, between which is the aforementioned interior, and which beams are rigidly connected to each other by the aid of the aforementioned roof beams.

In a more refined embodiment of the concept according to the invention the aforementioned frame structure of the car box of the elevator car comprises the vertical beam(s) of a first side and the vertical beam(s) of a second side, which are disposed in the corners of the rectangularly-shaped floor element and together with the floor element form the edge sides of a frame structure of rectangular prism shape.

All the joints referred to in this application can be implemented mechanically by connecting, e.g. with a screw and nut, by riveting, by welding or by gluing. The joint means can comprise a screw, a nut, a rivet, a stud, a nail or some other corresponding element suited to joining.

Some inventive embodiments are also presented in the descriptive section and in the drawings of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. The features of the various embodiments of the invention can be applied within the framework of the basic inventive concept in conjunction with other embodiments. The additional features mentioned by each preceding embodiment can also singly and separately from the other embodiments form a separate invention.

It is obvious to the person skilled in the art that in developing the technology the basic concept of the invention can be implemented in many different ways. The invention and the embodiments of it are not therefore limited to the examples described above, but instead they may be varied within the scope of the claims.

The invention claimed is:

1. An elevator car comprising a car box and a suspension device configured to support the car box in an elevator hoistway, the car box comprises:

an interior for receiving and transporting freight and/or passengers, said interior is bounded by at least a floor, walls, a roof, and a door arrangement, a floor element, vertical beam elements, and roof beam elements, which said floor element, vertical beam, and roof beam elements are connected to each other such that they form a load-bearing frame structure of rectangular prism shape, a plurality of planar elements of rectangular shape on an inside of said load-bearing frame structure fixed side-by-side to said load-bearing frame structure and extending essentially from one edge side of the car box to another, from which plurality a uniform wall surface and/or roof surface of the car box is formed, wherein said load-bearing frame structure and/or said planar elements comprises one or more sandwich beams and/or plate elements comprising a first skin and a second skin and one or more core elements, wherein said one or more core elements are formed from said first skin by cutting and bending or by punching along cutting edges of said first skin towards said second skin, said cutting and bending or punching forming an opening in said first skin, and joining said first skin to said second skin by said one or more core members, wherein said first skin has edge surfaces, and wherein said one or more core elements is spaced apart from said edge surfaces.

2. The elevator car according to claim 1, wherein said first skin and said second skin are of a thickness of 0.5-5 mm, and a thickness of the core of the one or more sandwich beams is 10-100 mm.

3. The elevator car according to claim 2, wherein said first skin and said second skin are 0.7-3 mm thick.

4. The elevator car according to claim 2, wherein said first skin and said second skin are 1-2.5 mm thick.

5. The elevator car according to claim 2, wherein the thickness of the core of the one or more sandwich beams is 15-50 mm.

6. The elevator car according to claim 1, wherein each of the one or more core members is formed symmetrically or asymmetrically with respect to an opening of said first skin.

7. The elevator car according to claim 1, wherein at least one edge of said one or more core members is straight.

8. The elevator car according to claim 1, wherein at least one edge of the opening is straight.

9. The elevator car according to claim 1, wherein the first skin and/or the second skin is made of metallic material.

10. The elevator car according to claim 1, wherein the first skin and/or the second skin is made of non-metallic material.

11. The elevator car according to claim 1, wherein the first skin and/or the second skin is of fire retardant plywood coated with a material layer comprising a fire retardant laminate.

12. The elevator car according to claim 1, wherein the one or more core members is formed from said first skin are joined to said second skin by welding, spot welding, adhesive bonding, riveting or by press-formed joints.

13. The elevator car according to claim 1, wherein the one or more sandwich beams and/or plate elements, in combination with said first skin and said second skin, comprises one or more beam elements forming at least part of said first skin and comprising one or more core elements, and wherein said one or more core elements are formed from said first skin by cutting and bending or punching along cutting edges of said first skin through to said core members towards said second skin and by joining said core members to said one or more sandwich beams and/or plate elements.

14. The elevator car according to claim 1, wherein one of the one or more sandwich beams and/or plate elements comprises ventilation ducts and/or ventilation openings and/or communications cables and/or electricity cables.

15. The elevator car according to claim 1, wherein the first skin and/or the second skin is made of plastic or fiber reinforced laminated polymer composite material.

16. The elevator car according to claim 1, wherein an outer surface of said sandwich beam and/or plate elements forms a part of an outer surface of the car box and/or the inner surface of said sandwich beams and/or plate elements forms a part of the inner surface of the floor and wall and roof bounding the interior.

17. The elevator car according to claim 1, wherein said suspension device of the elevator car is separate from the car box.

18. The elevator car according to claim 1, wherein the elevator car is suspended by said suspension device above and below the car box of the elevator car.

19. An elevator, which comprises comprising:

an elevator hoistway, and an elevator car arranged to move in the elevator hoistway, which elevator car is according to claim 1.

20. The elevator car according to claim 1, wherein the first skin and/or the second skin is make of stainless steel or aluminum.

* * * * *